United States Patent [19]

Wisner

[11] 4,286,634

[45] Sep. 1, 1981

[54] SAMPLE CONTAINER WITH COLLAPSIBLE FUNNEL

[76] Inventor: Elizabeth M. Wisner, P.O. Box 1336, Depot Bay, Oreg. 97341

[21] Appl. No.: 83,352

[22] Filed: Oct. 10, 1979

[51] Int. Cl.[3] ..... B65B 39/02; B67C 11/02

[52] U.S. Cl. ..... 141/95; 141/98; 141/338; 141/342; 206/218; 206/509; 220/8

[58] Field of Search ..... 141/94, 95, 98, 199-205, 141/297-300, 331-345, 363, 375; 206/216, 218, 509; 215/228; 220/8; 222/523, 538, 461

[56] References Cited

U.S. PATENT DOCUMENTS

| | | | |
|---|---|---|---|
| 842,086 | 1/1907 | Dixon | 141/95 |
| 1,510,631 | 10/1924 | Nutry | 141/338 |
| 1,740,418 | 12/1929 | Donnelly | 141/337 |
| 1,899,095 | 2/1933 | Knight et al. | 141/341 X |

FOREIGN PATENT DOCUMENTS

| | | | |
|---|---|---|---|
| 381262 | 11/1907 | France | 141/337 |

*Primary Examiner*—Frederick R. Schmidt
*Attorney, Agent, or Firm*—Chernoff & Vilhauer

[57] ABSTRACT

A plastic sample container with an attached collapsible funnel comprising several frusto-conical rings which interlock with one another in a raised position to form a funnel attached to an upright neck of the container. The funnel may be collapsed into the form of separate rings which rest upon radially extending upstanding support members attached to the top of the container. When the funnel is collapsed, the upper surfaces of the supporting members, the upper edges of the individual frusto-conical rings, and the top of a removable cap for the neck of the container all fall within a plane generally parallel with the bottom of the container, allowing several of the containers to be stacked one upon another. Graduations are provided on the side of the container, which is preferably constructed of tough translucent material, permitting visual ascertainment of the volume of a sample contained therein.

8 Claims, 7 Drawing Figures

SAMPLE CONTAINER WITH COLLAPSIBLE FUNNEL

BACKGROUND OF THE INVENTION

This invention relates to containers for liquid samples, and particularly to a plastic container having an attached collapsible funnel.

Reusable sample containers have many applications, both in industry and in scientific research. For example, in oceanography many samples of sea water are collected and stored for subsequent study, as when investigating distribution of various types of phytoplankton and zooplankton. In industrial situations it may often be desirable to obtain samples of chemical solutions at various points in apparatus used to carry out chemical reactions, and to study these samples at a later time. It is desirable to collect and store such samples in clean, sterile containers which are closeable to prevent the introduction of contaminants. Usually this has been accomplished by storing the samples in bottles which accept a pressure-fitted or threaded cap.

Because of the narrow neck of the bottles commonly used for storage of such samples, it is necessary usually to use a funnel when filling them. It is also necessary to provide shelving space on which to store the filled sample bottles. Providing isolation of separate samples requires the use of separate funnels to prevent contamination of samples by foreign material, particularly material left clinging to a funnel after the use of that funnel to pour previously obtained samples. Consequently, such funnels must be clean, and sterile and also must be provided in adequate numbers for the samples to be taken. The funnels themselves also require storage space, which may be in short supply aboard an oceangraphic research vessel, for example. Moreover, even when an adequate supply of funnels is available, there is always a risk that a previously used funnel will inadvertently be used with a new sample, resulting in unintended and unknown contamination.

Although collapsible funnels are known, as disclosed in such patents as Fuller U.S. Pat. No. 1,479,660, Welsh U.S. Pat. No. 1,256,961, Horstkotte U.S. Pat. No. 1,420,039, and Nutry U.S. Pat. No. 1,510,631, none of these patents discloses a funnel designed for use with a sample container or which collapses to a configuration convenient for stacking to minimize space requirements. In particular, Nutry discloses a collapsible funnel comprising interlocking rings, but the collapsed funnel includes a domed cap which is not suitable for supporting items. Fuller, Welsh and Horstkotte disclose funnels which may be stored within the neck of a container.

Accordingly, there is a need for a sample container that includes a collapsible integral funnel to facilitate pouring while eliminating the possibility of contamination from the funnel, and that facilitates stacking of such containers to minimize storage space requirements.

SUMMARY OF THE INVENTION

The shortcomings and disadvantages of the previously known sample containers and funnels for use therewith and the aforementioned need is satisfied by the present invention, which provides a plastic sample container comprising a plastic bottle-shaped vessel having an upwardly extending neck and a corresponding cap. A collapsible funnel is attached to the upwardly extending neck and may be raised to an upwardly extending self-supporting funnel configuration or lowered to a flat-topped collapsed configuration.

The funnel comprises several frusto-conical rings which interlock telescopically with one another to form the funnel when raised, and separate to fit concentrically within one another when the funnel is collapsed. When the funnel is in its raised configuration, a system of mating annular beads and grooves hold the several frusto-conical rings interlocked with one another to make the funnel fluid-tight.

A number of upstanding support members are mounted atop the bottle-shaped vessel to support the frusto-conical rings in a concentric arrangement wherein the top edge of each of the rings lies in a plane at least as high as the top of the bottlecap and the outer end of each of the support members, which preferably extend radially from the upwardly extending neck of the bottle-shaped vessel. Each of the support members forms a number of notches equal to the number of rings of the collapsible funnel to support the rings parallel with one another at a height such that the upper edges of the rings present a surface to support additional sample containers stacked one atop another.

The sample container of the present invention is preferably constructed of a tough, somewhat flexible and elastic plastic material which is translucent enough to allow determination of the volume of a liquid contained therein when reference is made to graduations along the vertical sides of the bottle-shaped vessel. Such flexibility and toughness also permit elastic deformation of the frusto-conical rings sufficiently to allow the rings to be snapped into a mating configuration.

It is a primary objective of the present invention to provide an improved plastic sample container having its own attached collapsible funnel.

It is another important objective of the present invention to provide a sample container which includes an attached funnel, yet is capable of being easily stacked atop similar containers to provide for storage of numerous similar sample containers in a restricted amount of space.

It is a further objective of the present invention to provide a sample container including an attached funnel which is reusable and may be easily cleaned and sterilized.

It is yet a further objective of the present invention to provide a sample container which may be sealed to prevent introduction of contaminating materials, yet which provides an indication of the volume of the sample material contained therein.

It is therefore an important feature of the present invention that it provides a reusable sample container which is equipped with its own funnel attached to the mouth of the container.

It is another important feature of the present invention that it provides a sample container having an attached funnel which may be collapsed to a flat-topped configuration permitting similar sample containers to be stacked one atop another.

It is a further feature of the present invention that it provides a plurality of radially-extending, notched support members spaced around the mouth of a sample bottle for supporting a collapsed funnel while permitting liquids to drain off the funnel and the top of the container.

It is yet a further feature of the present invention that it provides a translucent sample container having graduations which permit visual determination of the volume of a sample contained therein.

It is an advantage of the present invention that it eliminates the need to separately provide, clean, sterilize, and keep track of numerous separate funnels for use with various sample containers.

It is another advantage of the present invention that it provides sample containers which may be conveniently tightly closed, and may be stacked one upon another in order to conserve storage space.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
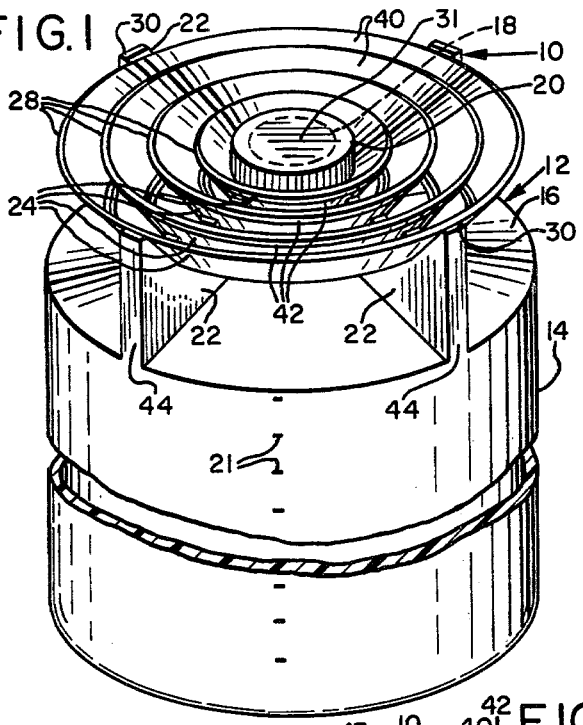
FIG. 1 is a pictorial view of a plastic sample container with a collapsible funnel which is an embodiment of the present invention, with the funnel in the collapsed configuration.
Figure 2:
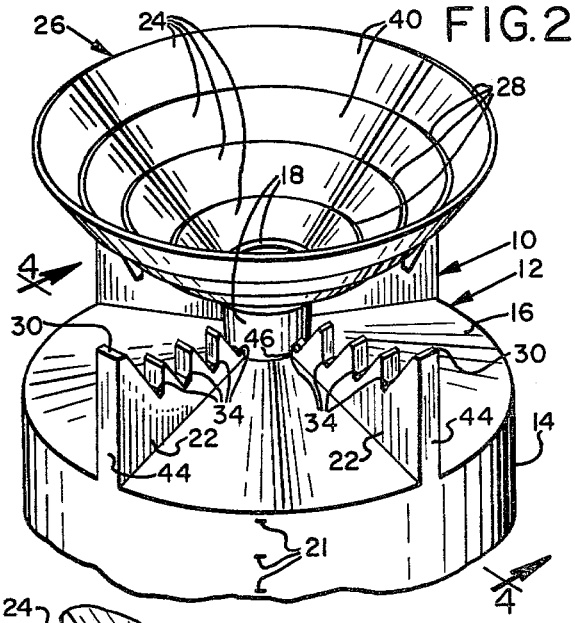
FIG. 2 is a pictorial view of the upper portion of the sample container shown in FIG. 1, with the funnel in the raised configuration.

Referring now to the drawings, an exemplary sample container 10 embodying the present invention may be seen in FIGS. 1 and 2. The sample container 10 comprises a generally cylindrical bottle 12 having a vertical side wall 14, a generally conical top portion 16, an upwardly extending neck 18 with a mouth therein (FIG. 2.), and a removable cap 20. Graduations 21 are provided on the side wall 14 to indicate volume contained inside the bottle 12.

At least three upstanding support members 22 are spaced around and extend radially along the top portion 16 of the container from the neck 18 toward the side wall 14. Resting upon the support members 22 in a flat-topped, concentric, nested configuration are a plurality of frusto-conical rings 24, which may be lifted to a raised configuration, shown in FIG. 2, in which the rings 24 interlock with one another to form a funnel.

Figure 3:
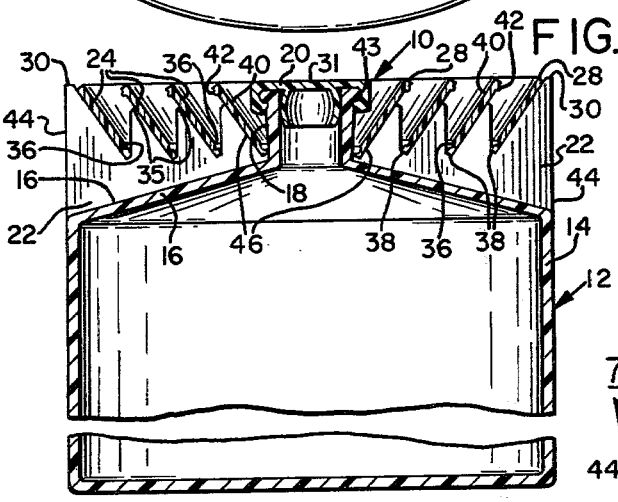
FIG. 3 is a sectional view of the container shown in FIG. 1, with the funnel in its collapsed configuration.

Referring now also to FIG. 3, it may be seen that when the rings 24 are separated from one another and the funnel 26 is in a collapsed configuration as shown in FIGS. 1 and 3, the top edge 28 of each of the rings 24 is aligned with the top end 30 of each of the support members 22, and also with the top surface 31 of the removable cap 20, such that the top edges 28, the top end 30, and the removable cap 20 cooperatively define a plane which is substantially parallel to the bottom 32 of the sample container 10. Each of the rings 24 rests in a corresponding notch 34 of each of the support members 22, with points 35 extending upward beneath the rings to provide support. The points 35 may be rounded to facilitate placement of the rings 24 into the notches 34.

Figure 5:
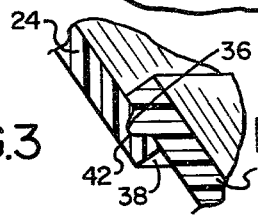
FIG. 5 is a sectional, detail view of the funnel of the sample container shown in FIG. 1.
Figure 4:
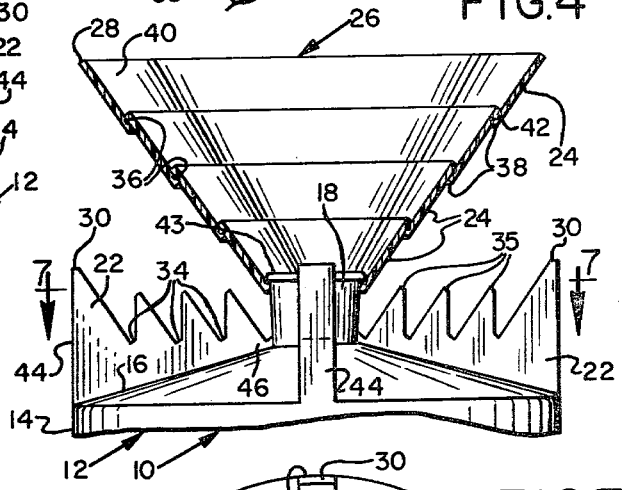
FIG. 4 is a sectional side view of the container shown in FIG. 1, with the funnel in its raised configuration, taken along line 4—4 of FIG. 2.

In order to hold the rings 24 together in a raised funnel configuration as seen in FIGS. 4 and 5, each ring 24 has defined therein an annular groove 36 located near the bottom edge 38 of the inner surface 40 of the ring. A corresponding annular bead 42 is located around the outside of the top edge 28 and mates within the annular groove 36 to support the rings 24 with respect to one another to hold the funnel in the raised configuration. Similarly, an annular lip 43 surrounds the neck 18 to support the funnel with respect to the neck 18.

Figure 6:
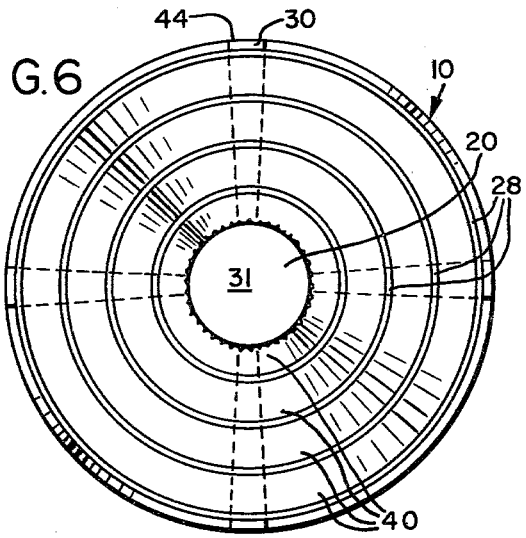
FIG. 6 is a top view of the upper portion of the container shown in FIG. 1, with the funnel in its raised configuration.
Figure 7:
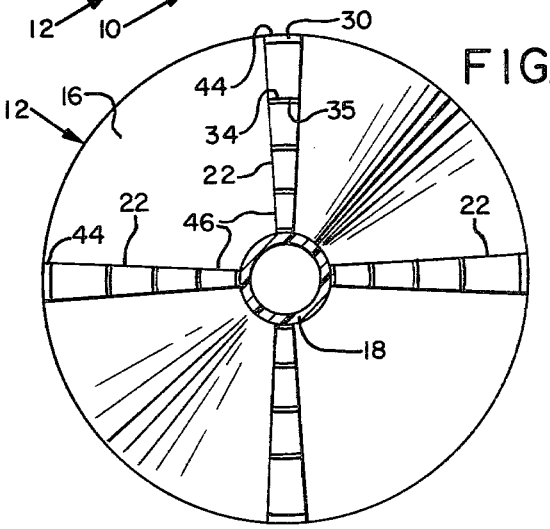
FIG. 7 is a top, sectional view of the sample container shown in FIG. 1, with the funnel in the raised configuration, taken along line 7—7 of FIG. 4.

Referring particularly to FIGS. 4 and 6, it may be seen that the support members 22 are wider at the outer end 44 than at the inner end 46, providing additional strength where needed because of the greater vertical height above the conical top surface 16 of the bottle 12.

The sample container of the invention may be constructed of any suitably strong self-supporting material; however, a preferred material is a tough translucent plastic material with sufficient elasticity to permit the frustoconical rings 24 to interlock tightly with one another. Preferably such a material would also be nonporous in order to avoid disagreeable odors caused by matter retained in the container material after washing.

The sample container 10 is used most advantageously by being transported in a sterile or sufficiently clean condition to the sample collection site with the funnel 26 in its collapsed configuration. If necessary, a suitable protective wrapping may be provided to preserve cleanliness until the sample container 10 is used. At the sample collecting site the rings 24 are lifted from the notches 34 and raised relative to the bottle 12 until the annular bead 42 of each ring 24 is received matingly within the annular groove 36 of each higher ring. Similarly the annular lip 43 of the upwardly extending neck 18 is received in the annular groove 36 of the bottom, innermost one of the rings 24. The rings are thus conjoined in a watertight raised configuration forming a funnel 26 which may be then used easily to pour samples into the sample container 10 until a desired amount is contained therein as determined by reference to the graduations 21 on the outside of the bottle 12.

When the sample has been obtained, the funnel 26 may be placed in its collapsed configuration by pressing downward upon rings 24 and dropping them into the respective notches 34 provided in the support members 22. The removable cap 20 may then be replaced to seal the mouth of the neck 18, preventing introduction of contaminants into the sample contained in the sample container 10.

The rings 24 may be rinsed off, if desired, while the funnel is in the collapsed configuration, and the conical top surface 16 will allow the rinsing water or solution, as well as spilled sample liquid to run off the sample container 10 quickly. A number of similar sample containers may then be stacked one upon another, since the funnel, in its collapsed configuration, along with the top ends 30 of the support members 22 and the top surface 31 of the removable cap 20, provides a supporting surface which is substantially parallel with the bottom 32 of the bottle 12.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A sample container, comprising:

(a) a body having a generally horizontal bottom and a side wall connected thereto;

(b) a top connected to said side wall, said top including an upwardly extending neck having an upwardly open mouth, and a sloping top surface extending downward from said neck toward said side wall;

(c) a collapsible funnel attached to said neck for guiding fluid through said mouth into said neck, said funnel comprising a plurality of interlockable, telescopically overlapping frusto-conical rings having respective top edges;

(d) support means attached to said top, for holding said frusto-conical rings; and (e) said support means comprising at least three upstanding support members spaced about said top, each of said upstanding support members defining a plurality of notch means therein for receiving and supporting said frusto-conical rings atop said container, wherein the respective top edges of at least some of said rings define a substantially planar horizontal surface for supporting an object such as a similar container stacked thereon when said funnel is in a collapsed configuration.

2. The container of claim 1 wherein said side wall is generally vertical and each of said upstanding support members extends away from said neck toward said vertical side wall and has a top end defining a part of said substantially planar surface and an outer end extending upward in alignment with said vertical side wall, for supporting an object such as said bottom of another similar container thereon, said notch means being arranged to hold said rings in a concentric arrangement spaced upwardly away from said top surface of said container.

3. The container of claim 1 further comprising removable cap means for closing said mouth of said upwardly extending neck, a surface of said cap means defining a part of said substantially planar surface.

4. The container of claim 1, further comprising graduation means defined along said side wall of said container body for determining the volume contained therein, said side wall being made of a translucent material.

5. The container of claim 1 wherein said upwardly extending neck comprises radially-extending annular lip means for interlockingly retaining said funnel in a position attached to said neck and for supporting said funnel in a raised configuration.

6. The container of claim 1 wherein said top of said container is sloped downward from said neck allowing liquid to drain from the exterior of said top.

7. The container of claim 1 wherein each said frusto-conical ring includes elastic interlocking means for retaining each ring in engagement with a next adjacent ring so as to form a water-tight funnel.

8. The container of claim 7 wherein said elastic interlocking means comprises an annular bead disposed around an edge of each said ring and a corresponding mateable annular groove around an edge of said next adjacent ring.

* * * * *